US010895264B2

(12) United States Patent
Bigi et al.

(10) Patent No.: US 10,895,264 B2
(45) Date of Patent: Jan. 19, 2021

(54) MOTORCOMPRESSOR AND METHOD TO IMPROVE THE EFFICIENCY OF A MOTORCOMPRESSOR

(71) Applicant: Nuovo Pignone Tecnologie Srl, Florence (IT)

(72) Inventors: Manuele Bigi, Florence (IT); Giuseppe Sassanelli, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 270 days.

(21) Appl. No.: 15/748,113

(22) PCT Filed: Jul. 28, 2016

(86) PCT No.: PCT/EP2016/068030
§ 371 (c)(1),
(2) Date: Jan. 26, 2018

(87) PCT Pub. No.: WO2017/017202
PCT Pub. Date: Feb. 2, 2017

(65) Prior Publication Data

US 2018/0209428 A1 Jul. 26, 2018

(30) Foreign Application Priority Data

Jul. 28, 2015 (IT) ..... 102015000038906

(51) Int. Cl.
*F04D 25/06* (2006.01)
*F04D 29/10* (2006.01)
(Continued)

(52) U.S. Cl.
CPC ..... *F04D 25/0686* (2013.01); *F04D 29/102* (2013.01); *F04D 29/5806* (2013.01); *F04F 5/467* (2013.01); *F04D 29/4206* (2013.01)

(58) Field of Classification Search
CPC ..... F04D 25/0686; F04D 29/102; F04D 29/5806; F04D 29/4206; F04F 5/467
(Continued)

(56) References Cited

U.S. PATENT DOCUMENTS 5,281,088 A * 1/1994 Brandt ..... F04D 29/588 415/171.1
6,655,932 B1 12/2003 Stinessen et al.
(Continued)

FOREIGN PATENT DOCUMENTS

EP 1 826 887 A2 8/2007
EP 2 447 539 A2 5/2012

OTHER PUBLICATIONS

Italian Search Report and Written Opinion issued in connection with corresponding IT Application No. 102015000038906 dated Apr. 15, 2016.

(Continued)

*Primary Examiner* — Connor J Tremarche
(74) *Attorney, Agent, or Firm* — Baker Hughes Patent Organization

(57) ABSTRACT

A motorcompressor comprising an electric motor, a load, a shaft assembly, the electric motor and the load being mounted on the shaft assembly, a casing configured to completely house the electric motor, the load and the shaft assembly for its entire length, a divider located in the casing to define a motor chamber and a load chamber, the divider comprising at least a pumping device configured to transfer a part of the fluid present in the motor chamber to the load chamber so as to obtain in the motor chamber a pressure that is lower than a pressure at a load inlet.

6 Claims, 2 Drawing Sheets

(51) Int. Cl.
*F04D 29/58* (2006.01)
*F04F 5/46* (2006.01)
*F04D 29/42* (2006.01)

(58) Field of Classification Search
USPC ..... 417/87
See application file for complete search history.

(56) References Cited

U.S. PATENT DOCUMENTS

| | | | | |
|---|---|---|---|---|
| 8,579,608 | B2 * | 11/2013 | Nijhuis | F04D 29/057 417/423.12 |
| 2005/0142004 | A1 * | 6/2005 | Appleford | F04D 25/06 417/371 |
| 2007/0200438 | A1 * | 8/2007 | Kaminski | F04D 1/063 310/54 |

OTHER PUBLICATIONS

International Search Report and Written Opinion issued in connection with corresponding PCT Application No. PCT/EP2016/068030 dated Nov. 4, 2016.
International Preliminary Report on Patentability issued in connection with corresponding PCT Application No. PCT/EP2016/068030 dated Jan. 30, 2018.

* cited by examiner

MOTORCOMPRESSOR AND METHOD TO IMPROVE THE EFFICIENCY OF A MOTORCOMPRESSOR

TECHNICAL FIELD

Embodiments of the subject matter disclosed herein correspond to a motorcompressor, in particular of the type comprising an electric motor and a load housed inside a common casing.

BACKGROUND

In the field of "Oil & Gas", motorcompressors are widely used. In particular, in subsea applications, such motorcompressors comprise a motor and a load mounted on the same shaft. A common casing houses the motor, the load and the shaft.

A wall located inside the casing divides it in a motor chamber and in a load chamber. The shaft crosses the wall, and seals are located between the wall and the shaft so as to isolate the motor chamber form the load chamber.

The cooling of the electric motor is usually performed with process gas withdrawn at the load inlet pressure. This solution makes it possible to operate the electric motor within a temperature range of high efficiency allowing it to deliver the maximum rated power.

The cooling efficiency depends on the gas properties and, in particular, there is a range of pressure in which it is maximum. For low-pressure conditions, usually below 20-30 bar, the density of the gas becomes so low that the cooling starts to be ineffective. On the other hand, for higher pressures, above 100 bar, the high density of the gas generates high windage losses.

When the suction pressure is 200 bar or more, the efficiency of the electric motor severely decreases. In fact, windage losses of the electric motor became very high, making the cooling method substantially ineffective. In this condition, the motor needs to be operated at a power that is lower than the maximum deliverable power.

SUMMARY

Therefore, there is a general need for an improved motorcompressor.

In particular, the motorcompressor is of the type comprising an electric motor and a load housed inside a common casing, suitable for subsea applications.

An important idea is to use a pumping device configured to transfer a fluid present in the motor chamber into the load chamber, to lower the motor working pressure. With a lower pressure in the motor chamber, the motor works with higher efficiency.

One embodiment of the subject matter disclosed herein corresponds to a motorcompressor.

Another embodiment of the subject matter disclosed herein corresponds to a subsea assembly.

An additional embodiment of the subject matter disclosed herein corresponds to a method to improve the efficiency of a motorcompressor.

BRIEF DESCRIPTION OF DRAWINGS

The accompanying drawings, which are incorporated herein and constitute a part of the specification, illustrate exemplary embodiments of the present invention and, together with the detailed description, explain these embodiments. In the drawings.

DETAILED DESCRIPTION

The following description of exemplary embodiments refers to the accompanying drawings and does not limit the invention. Instead, the scope of the invention is defined by the appended claims.

The description relates to a motorcompressor having a motor chamber housing a motor and a load chamber housing a load (like a compressor, a pump or similar). There is a pumping device configured to transfer a fluid present in the motor chamber to the load chamber to reduce the pressure inside the motor chamber. With a lower pressure in the motor chamber, the motor works with higher efficiency.

Figure 1:
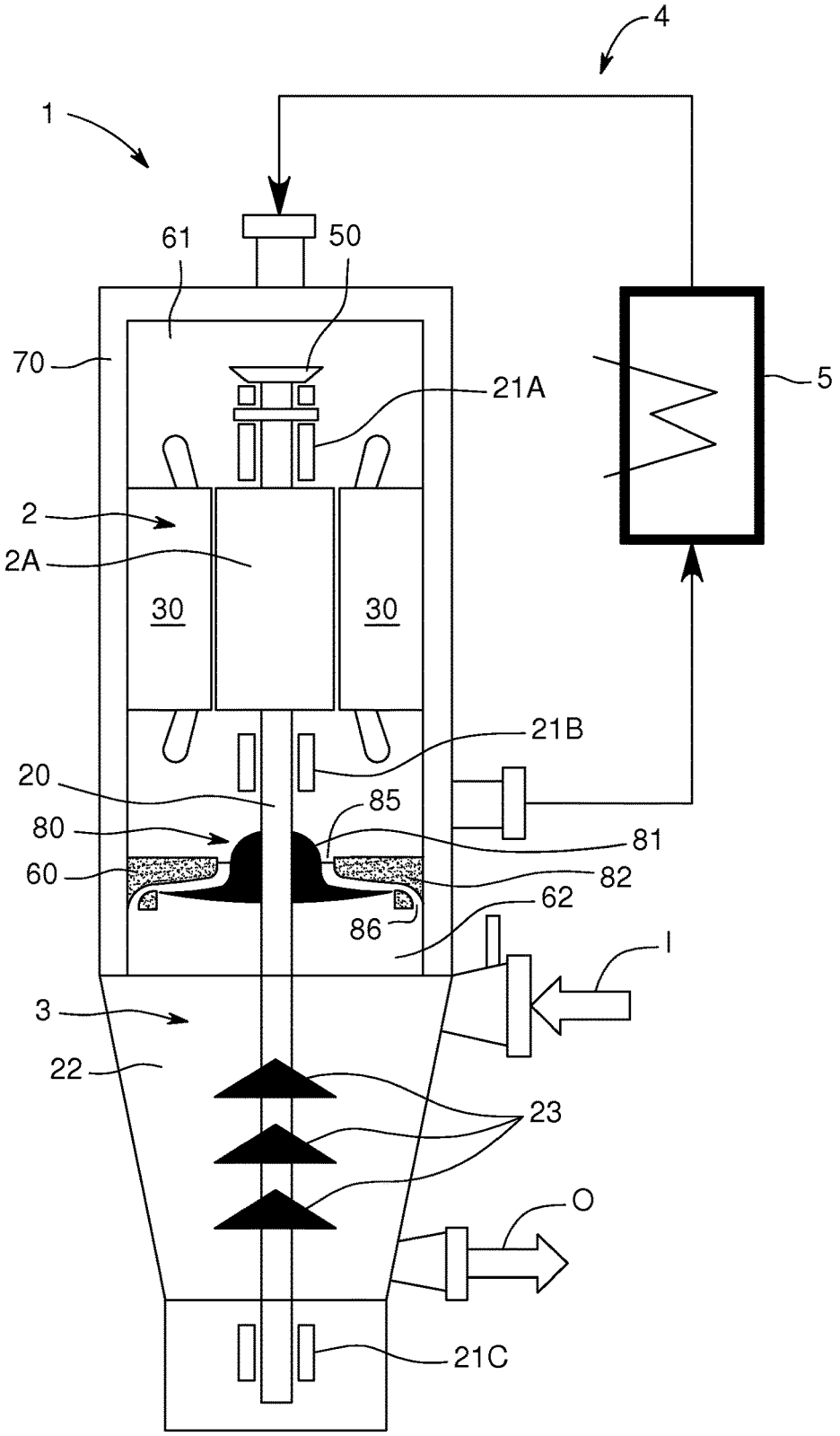
FIG. 1 is a simplified axial section of a motorcompressor according to one aspect of the present invention.

The motorcompressor 1 is schematically represented in FIG. 1, and may be a subsea assembly like a subsea motorcompressor, comprising in the same casing 70 (that may also be formed by different parts mutually connected) an electric motor 2 and a load 3. The load 3 may be a compressor, in particular a centrifugal compressor, an axial compressor, a helico-axial compressor, or a pump.

The rotor 2A of an electric motor 2 may be torsionally fixed to a shaft assembly 20, rotatably mounted on supporting bearings 21A, 21B, 21C. The shaft assembly 20 may drive the load 3.

In FIG. 1 the load 3 is a centrifugal compressor having a plurality of load impellers 23 mounted on the shaft 20, inside a load stator 22.

The centrifugal compressor may have an inlet I and an outlet O of a process gas, which may be natural gas and may comprise liquid particles.

The shaft assembly 20 may be formed in a single piece on which the load 3 and the motor 2 are mounted, or it may be formed by a plurality of parts torsionally coupled to form a shaft line.

A first bearing 21A of the motor may be radial and may include a thrust bearing, while a second 21B and third 21C bearing may be radial.

Some motorcompressors, in particular subsea motor-compressor units, may employ oil-lubricated bearings for supporting the driving shaft; others employ magnetic bearings, or active magnetic bearings. Other integrated machines include hydrodynamic, hydrostatic or hybrid (hydrostatic/hydrodynamic) bearings, using a fluid, either liquid or gaseous, to generate a force radially or axially supporting the rotating shaft.

A coolant circuit 4 may be least partially located in thermal contact with the electric motors or with parts of it. The coolant circuit 4 may be designed to cool down the electric motor, the bearings and other parts of the motorcompressor. It may comprise a coolant pump 50 torsionally fixed to the shaft 20 to circulate the coolant into the circuit.

The coolant circuit may 4 also comprises a cooling assembly 5 that may be located externally with respect to motorcompressor 1.

The casing 70 houses the electric motor 2, the load 3 and the shaft assembly 20 (for its entire length).

A divider 60 is located in the casing 70 separating a motor chamber 61 from a load chamber 62.

The divider 60 comprises at least a pumping device configured to transfer a fluid present in the motor chamber 61 to the load chamber 62 to lower the pressure in the motor chamber 61, at least when the motorcompressor is in operation.

In the embodiment of FIG. 1, the pumping device is a turbomachinery 80, and in particular, a centrifugal compressor comprising at least an impeller 81 rotatably mounted within a statoric portion 82.

The impeller 81 may be of the shrouded (or closed type), but in another embodiment it is of the unshrouded (or open) type to allow high peripheral speed. The open impeller may be designed with very low phi (φ=flow coefficient) to limit the adsorbed power, and with high surge tolerance in order to operate with a low flow and high pressure ratio.

In a possible configuration, the impeller 81 is torsionally coupled with the shaft assembly 20.

A turbomachinery inlet 85 may be fluidly connected to the motor chamber 61 while a turbomachinery outlet may be fluidly connected to the load chamber 62, and specifically with the load inlet I.

When the electric motor 2 is in operation, the shaft assembly 20 rotates the impeller 81 that transfers part of the fluid present in the motor chamber 61 into the load chamber 62. Consequently, the pressure inside the pressure inside the motor chamber 61 decreases and the motor may work at a pressure that may be lower than the inlet pressure of the load 3. The impeller 81 may be configured to lower the pressure of the motor chamber to ½ (or better up to ¼) of the pressure in the load chamber 62.

This improves the efficiency of the motor 2 that may work within a fluid with a lower density with respect to the fluid at the load inlet I.

Figure 2:
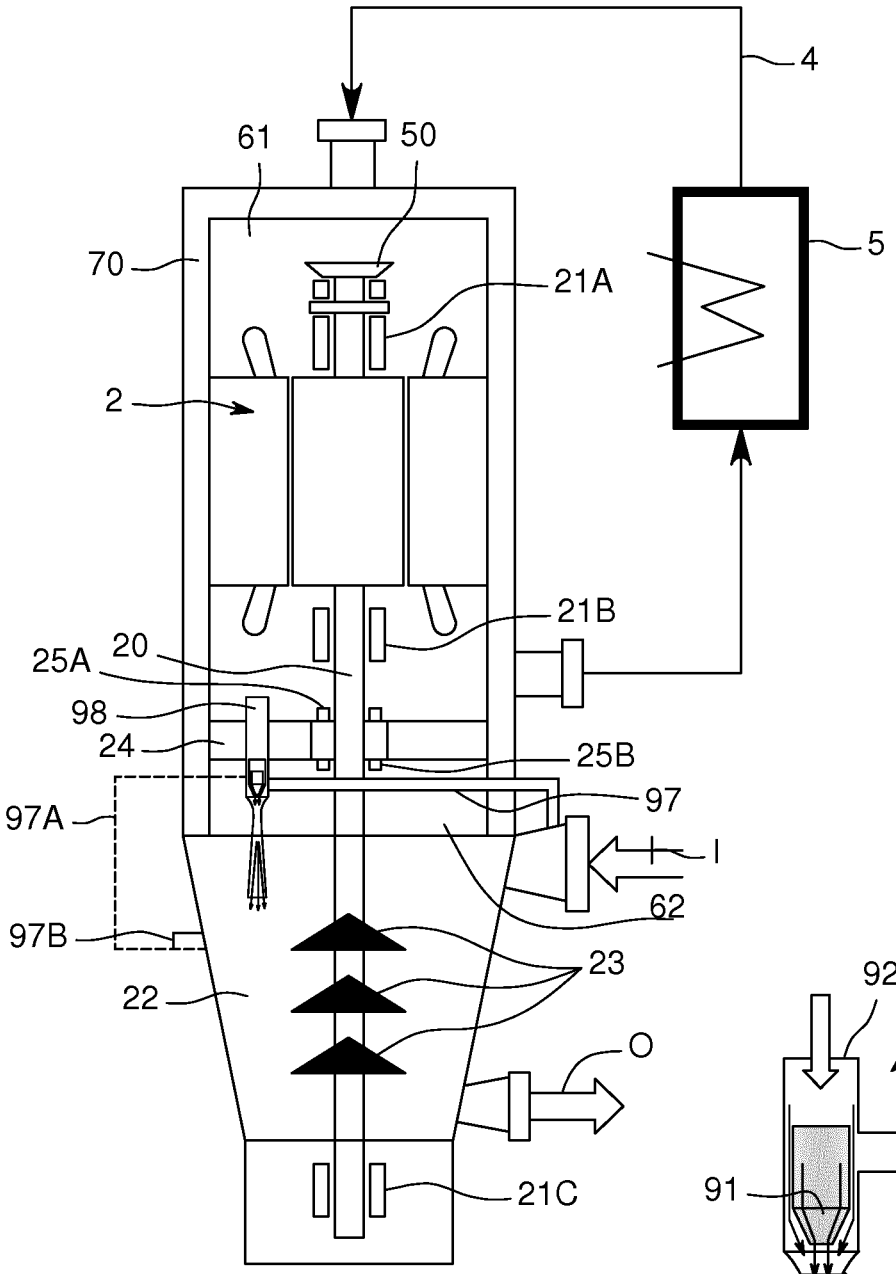
FIG. 2 is a simplified axial section of another embodiment of the motorcompressor according to the present invention.

FIG. 2. shows another embodiment of the motorcompressor.

In the description of this embodiment, those parts functionally similar to the ones already described will be indicated with the same reference numbers, and their description will be omitted.

Figure 3:
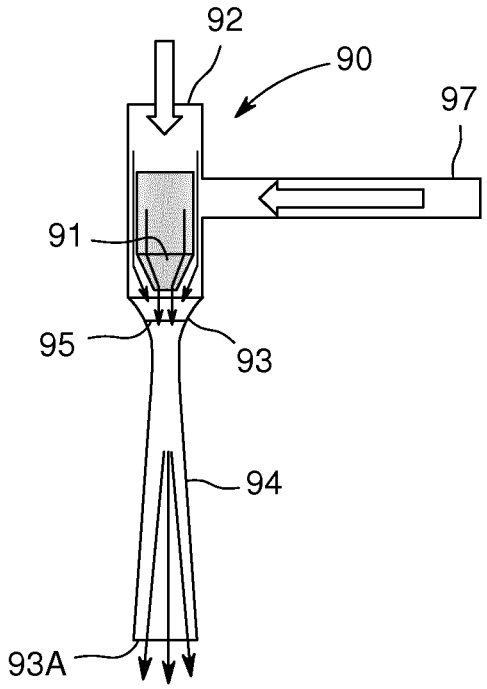
FIG. 3 is an enlarged simplified view of the particular surrounded by a circle in FIG. 2.

In the described embodiment, the divider 60 comprises a wall 24 having a first seal 25A and second seal 25B acting on the shaft assembly 20. The wall 24 comprises a pumping device, that is specifically is an ejector 90. FIG. 3 shows the ejector 90 in an enlarged view.

In particular, the ejector 90 comprises a motive fluid nozzle 91 that may be connected to an inlet I of the load 3 through a dedicated pipeline 97. An ejector inlet 92 is placed in fluid connection with the motor chamber 61 by a through hole 98 made in the wall 24. The ejector outlet 93A is fluidly connected with the load chamber 62. In this embodiment, the ejector is completely contained inside the load chamber 62.

In a different solution, (see the dotted line 97A of FIG. 2) the motive fluid nozzle 91 may be connected to a bleeding tap 98B at an upstream stage of the load 3, where the process fluid pressure is higher than the pressure present at the inlet of the load 3. With this solution, the fluid feeding the motive fluid nozzle may have a pressure that may be higher than the pressure present at the inlet I of the load 3.

Coming back to FIG. 3, it may be appreciated that the motive fluid nozzle 91 is located upstream to a converging inlet nozzle 93 followed by a diverging outlet nozzle 94. A diffuser throat 95 is present at the interface between the converging inlet nozzle 93 and the diverging outlet nozzle 94.

The fluid flowing through the motive fluid nozzle and reaching the diffuser throat 95, generates a depression at the ejector inlet 92 that pumps fluid form the motor chamber 61 to the load chamber 62.

In this condition, with a suitable number of ejectors 90 (a single ejector may not be sufficient), the pressure inside the motor chamber 61 may be lowered so as to improve the efficiency of the motor 2 (as in the embodiment described before).

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

The invention claimed is:

1. A motorcompressor comprising:

an electric motor;

a load;

a shaft assembly, the electric motor and the load being mounted on the shaft assembly;

a casing configured to completely house the electric motor, the load and the shaft assembly; and a divider located in the casing to define a motor chamber and a load chamber, the divider comprising at least a pumping device configured to transfer a part of a fluid present in the motor chamber to the load chamber so as to obtain in the motor chamber a pressure that is lower than a pressure at a load inlet, wherein the pumping device is an ejector, and wherein the ejector comprises a motive fluid nozzle fluidly connected to an inlet of the load or to a bleeding tap present at an upstream stage of the load.

2. The motorcompressor of claim 1, wherein the ejector comprises an ejector inlet fluidly connected to the motor chamber and an ejector outlet fluidly connected to the load chamber.

3. The motorcompressor of claim 2, wherein the motive fluid nozzle is located upstream to a converging inlet nozzle.

4. The motorcompressor of claim 1, wherein the motive fluid nozzle is located upstream to a converging inlet nozzle followed by a diverging outlet nozzle, the converging inlet nozzle and the diverging outlet nozzle being connected at a diffuser throat.

5. The motorcompressor of claim 1, wherein the shaft assembly is a single shaft or it is formed by a plurality of parts torsionally connected each other.

6. Subsea assembly comprising a motorcompressor according to claim 1.

* * * * *